United States Patent [19]

Lonati

[11] 4,180,991

[45] Jan. 1, 1980

[54] METHOD AND DOUBLE-CYLINDER CIRCULAR KNITTING MACHINE FOR MANUFACTURING PATTERNED KNITTED FABRICS

[75] Inventor: Francesco Lonati, Brescia, Italy

[73] Assignee: Costruzioni Meccaniche Lonati S.p.A., Brescia, Italy

[21] Appl. No.: 853,709

[22] Filed: Nov. 21, 1977

[30] Foreign Application Priority Data

Dec. 1, 1976 [IT] Italy ..... 30007 A/76

[51] Int. Cl.[2] ..... D04B 9/10

[52] U.S. Cl. ..... 66/14; 66/227

[58] Field of Search ..... 66/14, 227

[56] References Cited

U.S. PATENT DOCUMENTS

| | | | |
|---|---|---|---|
| 2,019,396 | 10/1935 | Deans et al. | 66/14 X |
| 2,717,509 | 9/1955 | Briston | 66/14 |
| 4,036,033 | 7/1977 | Jesson | 66/14 |

FOREIGN PATENT DOCUMENTS

| | | | |
|---|---|---|---|
| 230006 | 11/1963 | Austria | 66/14 |
| 930805 | 7/1963 | United Kingdom | 66/14 |
| 1083664 | 9/1967 | United Kingdom | 66/14 |

*Primary Examiner*—Wm. Carter Reynolds

*Attorney, Agent, or Firm*—Guido Modiano; Albert Josif

[57] ABSTRACT

There is disclosed a method of manufacturing patterned knitted fabrics on a double cylinder knitting machine, in which the pattern jacks associated with needles in the lower needle cylinder having already picked up a yarn at any of the feeds but one thereof are brought into a position in which they can no longer be selected to bring the associated needles to knit in the same knitting course. Same occurs for the jacks associated with the needles knitting in the upper needle cylinder. All these jacks are then brought into a position capable of being raised on the jack raising cam associated with the remaining feed, but only those jacks are raised which are associated with needles knitting in the upper needle cylinder. The machine has a number of jack selecting devices which is by one unit smaller than the number of yarn feeds, and cams for causing the jacks to move as above described.

7 Claims, 8 Drawing Figures

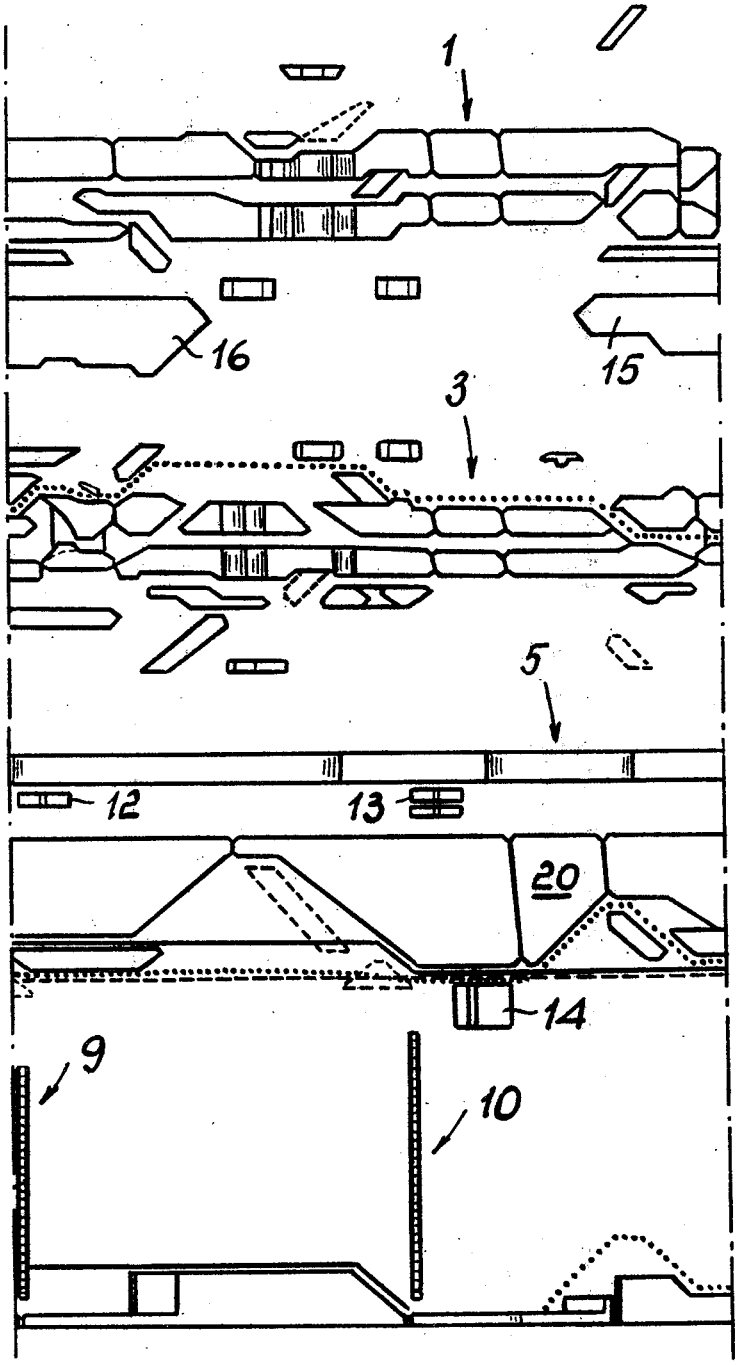
PRIOR ART Fig. 1a

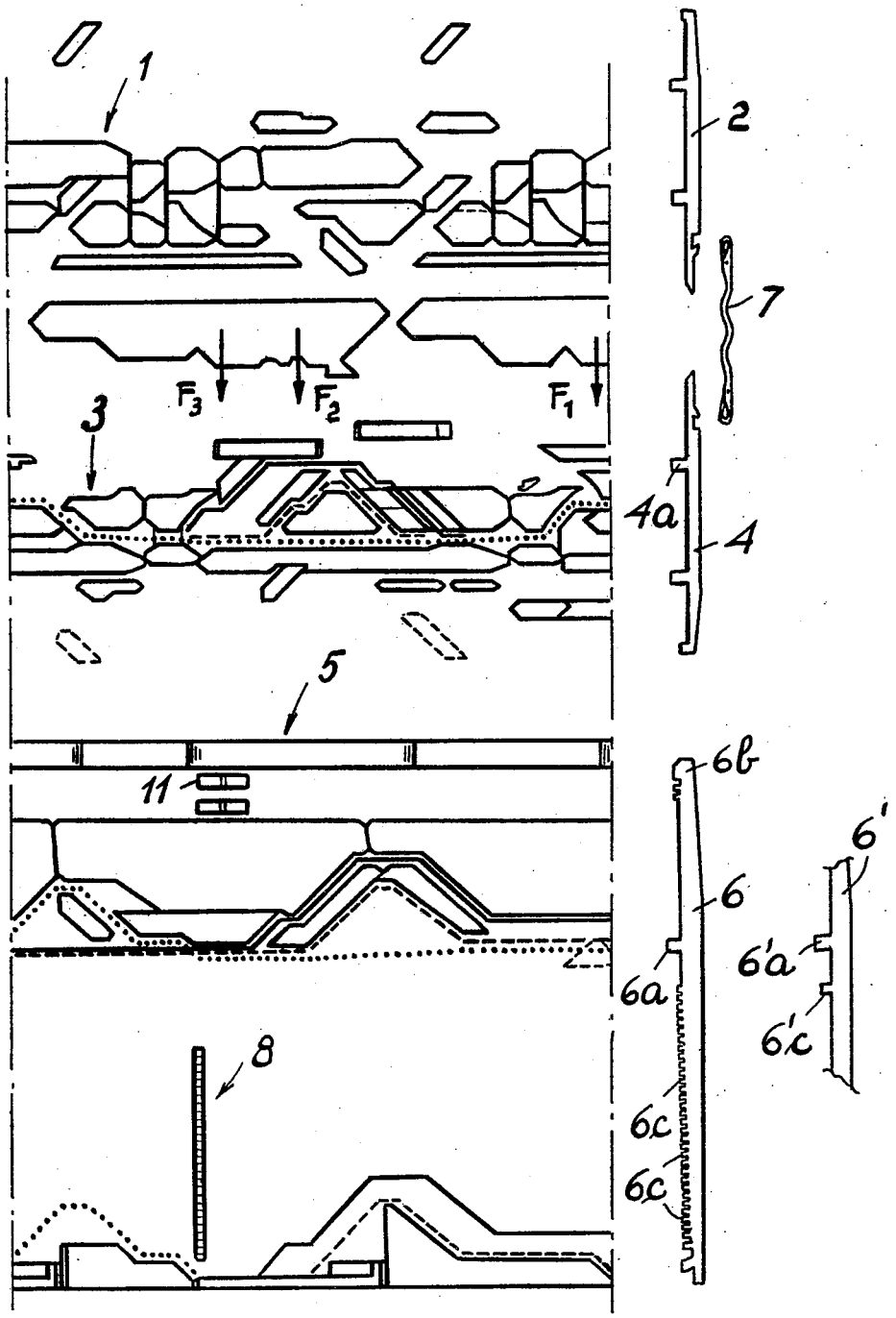
PRIOR ART Fig. 1b

METHOD AND DOUBLE-CYLINDER CIRCULAR KNITTING MACHINE FOR MANUFACTURING PATTERNED KNITTED FABRICS

BACKGROUND OF THE INVENTION

This invention relates to a method and to a double-cylinder circular knitting machine for manufacturing patterned knitted fabrics, in particular stocking articles with automatic parting of one stocking from another, i.e. separation of a completed stocking from the following one.

More specifically, the invention concerns a method and a knitting machine for producing either so-called "links" or "links-floating" knitwork or "Jacquard" knitwork in two or three colors, or even "links-Jacquard" knitwork in two colors, on ribbed or "derby" knitwork. As is known to the expert in the art, such terms define respectively knitting operations wherein a pattern is obtained by varying the number and arrangement of purl stitches, varying the number and arrangement of purl stitches while holding one of the colored yarns free (floating) behind the plain stitches, varying yarns of different colors on the plain stitching and on ribbed knitwork, by combining "links" knitting with "Jacquard" knitting as mentioned above on ribbed knitwork with plain and purl stitches.

Pattern knitting machines are provided with a plurality of selecting devices, specifically in the form of pattern drums, intended to select for operation such needles as the pattern to be effected may require. The selecting mechanism comprising pattern drums is well known to the expert in the art, and will be just touched upon herein. It is, in fact, a matter of acting on the butts of the jacks which are associated with the needles such as to push these jacks into respective tricks in the cylinder when the corresponding overlying needles are not required to operate at a given feed, and by contrast allow the jacks of those needles which are to be operated to partially project out of the tricks, and this in order to allow the latter jacks to be raised on specially provided cams and cause the corresponding needles to pick up the yarn and form a stitch at the following feed. Such a selection is obtained by the drums having a plurality of peripherally arranged pegs or teeth separated by blanks, according to the pattern to be produced. The jacks are usually operated through selecting levers or latches intervening between the drums and jacks.

Double cylinder machines with automatic separation of the finished product from the following one yet to be completed require as many pattern drums as are the yarn feeds. For instance, for a three-color Jacquard pattern stocking, where each color is supplied by one feed, three pattern drums are required, on for each feed.

The problems involved in the arrangement of such drums are manifold. First of all, it should be noted that the arrangement of plural pattern drums poses constructional problems owing to the limited space available either for the drums and the selecting levers associated therewith. Furthermore, it should be considered that the work involved in presetting the drums, i.e. in arranging the various pegs or teeth according to the pattern to be obtained, is time consuming, and the more so the larger is the number of pattern drums, while it is susceptible to errors which would cause product rejection and require the machine to be stopped to check the drums for pegs or teeth arranged in the wrong way. The likelihood of an erroneous disposition is obviously increased as the number of pattern drums increases. Moreover, it should be considered that when it is desired to change the pattern, it is necessary that all of the pattern drums be newly preset, with the attendant problems mentioned above. All this reflects in not negligible additional costs in manufacturing and adjusting a knitting machine for patterned knitted garments.

SUMMARY OF THE INVENTION

It is a primary object of this invention to obviate the cited constructional and economical problems by providing a method and a machine capable of effecting the various knitting operations mentioned above with a number of pattern drums which is smaller than the number of feeds, while retaining the automatic finished product separation feature.

In fact, and as is known, in carrying out the product automatic separation, as disclosed, for example, in the Italian Pat. No. 913,183 issued to Francesco Lonati, the needles operating in the upper cylinder of a double cylinder machine, on releasing the finished knitwork, are left without a yarn, thereby their respective latches are likely to close by gravity against the needle hook, thus making it impossible to resume knitting for the following product. In this case, it becomes necessary to ensure the opening of such upper cylinder needles before the yarn for a fresh product is picked up, this being impossible to accomplish through the use of latch-opening pins as is done for the lower cylinder needles. Thus, the underlying sliders of the lower cylinder must be actuated, which sliders have to be specially selected to carry out this step. This invention is also directed to provide such a selection while maintaining the number of the selecting drums smaller than the number of feeds or feeding stations.

According to the invention, these objects are achieved by a method for manufacturing patterned knitted fabrics, in particular stocking articles, with automatic separation of the finished product from the following one, on a double cylinder circular knitting machine having plural feeding stations, the method being characterized in that the jacks corresponding to the lower cylinder needles operating at the various feeding stations but one such feeding station and the jacks corresponding to the needles operating in the upper cylinder are brought, after the corresponding needles have formed a stitch, to an inoperative position in which they do not interfere with the tilt-out cam associated with said but one feeding station, that said jacks are subsequently brought all to a position such that they can be raised to bring the corresponding needles to work at said but one feeding station, and that from said jacks, those jacks which are associated with the needles operating in the lower cylinder, and having already formed a stitch in said same course, are precluded from said raising movement.

For the implementation of the inventive method, this invention further provides a double cylinder circular knitting machine having plural yarn feeding stations and including selecting devices for the jacks associated with the machine needles and tilt-out cams for disposing the jacks in a position suitable for selection by said selecting devices, the machine being characterized in that it comprises a number of selecting devices by one unit smaller than the number of yarn feeding stations, and in that upstream of the selecting position associated with the feeding station lacking a selecting device, there are provided in the following order: a cam effective to hold the jacks corresponding to the lower cylinder needles operating at the other feeding stations and the jacks corresponding to the needles operating in the upper cylinder at a level of non-interference with the tilt-out cam associated with said selecting position lacking a selecting device, an auxiliary tilt-out cam effective to bring all of the jacks movable at said level to a position suitable for raising to work, and a resetting cam effective to preclude from raising the jacks movable at said level being associated with the needles operating in the lower cylinder and having already formed a stitch in the same course.

The method and machine according to this invention afford the elimination of one selecting device (drum), since those jacks which have already been selected at one feed are all brought to a position that precludes any further selection thereof for the same knitting course, thereby at a certain point, and regardless of the number of feeds, there only remain the jacks associated with the lower cylinder needles which have not yet been driven to form a stitch, for which jacks, however, no selecting device is required any more, for they must all be raised to bring to work the corresponding needles. Furthermore, the inventive method and machine ensure positive opening of the latches of the upper cylinder needles since of all the jacks brought to a no more selectable position after the associated needles have formed a stitch, those associated with needleless sliders (because their needles are rib knitting in the upper cylinder) are selected and brought to open the latch of the overlying needle, while those associated with sliders the needles whereof have already worked in the lower cylinder at respective ones of the previous feeds, are held in the position unsuitable for selection until all of the jacks are raised to bring to work the respective needles, thus completing the course.

BRIEF DESCRIPTION OF THE DRAWINGS

Further features and advantages of this invention will be apparent from the following description of some preferred but not restrictive embodiments thereof, illustrated herein by way of example only and shown in the accompanying drawings, where:

FIGS. 1*a* and 1*b* show the cams of a conventional double cylinder circular knitting machine equipped with three feeding stations and three selecting devices (pattern drums), the two figures being to be considered as contiguous to each other and representing each a portion of the cam assembly, one part of each portion appearing, for clarity, duplicated in either figure;

DESCRIPTION OF THE PREFERRED EMBODIMENTS

Figure 2A:
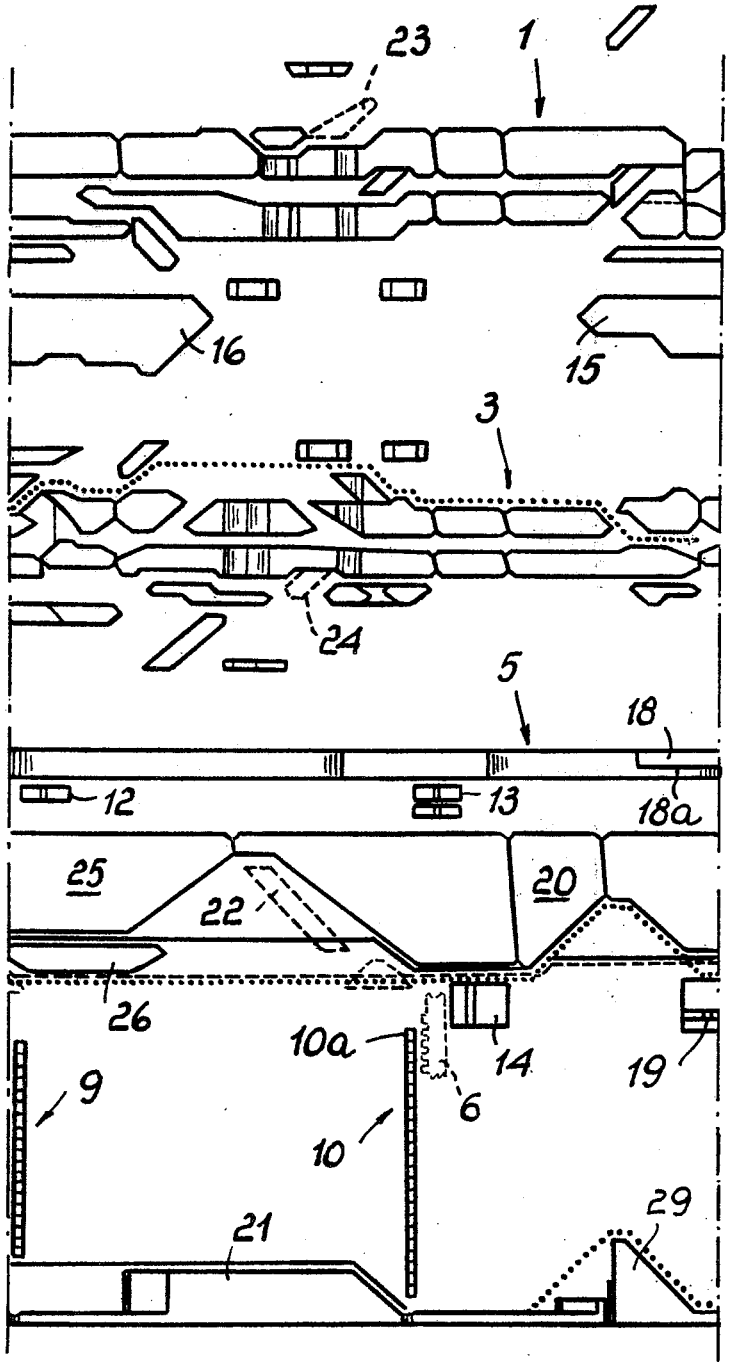
FIGS. 2*a* and 2*b* are views of the cams of a machine according to the invention comprising three feeding stations, and the same comments applies thereto as for FIGS. 1*a* and 1*b;*

To make the invention more clearly understood, reference will be made first to the prior art machine shown in FIGS. 1*a* and 1*b,* which comprises an upper cam assembly 1 for controlling the sliders 2 of the upper needle cylinder, a lower cam assembly 3 for controlling the sliders 4 of the lower needle cylinder, and a cam assembly 5 for controlling the tilting jacks 6. The numeral 7 denotes a needle of the machine, and at F1, F2 and F3 feeding stations are indicated wherewith there are associated respectively the selecting devices in the form of levers or latches 8,9,10, all of conventional design, which are actuated by respective pattern drums, not shown. Dotted, dash and full lines represent the paths followed by the upper butts 4*a* of the sliders 4 and of the center butts 6*a* of the jacks 6, and precisely: in dotted lines the paths of the sliders and of the jacks associated with the lower cylinder needles which are knitting at the first feed F1, in dash lines the paths of the sliders and jacks associated with the needles which are knitting at the second feed F2, and in full lines the paths of the sliders and jacks associated with the needles which are knitting at the third feed F3.

Also shown in dash lines are the cams which are movable radially to the needle cylinder, such that they can be moved to a position whereat they act on the butts of the sliders or jacks, and to a position whereat they do not act thereon. The numerals 11,12 and 13 denote the tilt-out cams of the jacks 6, intended to bring the jacks to a position suitable for selection by the devices 8,9,10 and acting on the heads 6*b* of the tilting jacks, while 14 denotes a resetting cam intended to bring the jacks 6 to a position within respective needle tricks such as to cancel any previous selection. The individual cams of the cam assembly require no further description because they are of well known design.

In addition to the jacks 6 associated with the lower cylinder needles which operate at the various feeds, provision is made for so-called neutral jacks 6', which are associated with those needles which are rib knitting in the upper cylinder. Such neutral jacks have only one butt 6'*c* instead of the normal pattern butts 6*c* shown in the drawings, as detailed on one side of FIG. 1*b,* thereby they are always tilted out by the cams 11 and 13, without undergoing resetting by the following selection devices, such that they are always raised to bring their respective sliders to a position such as to cross the overlying needles of the upper cylinder and open their latches every time before they pick up the yarn. As is known, these pick up the yarn at all of the feeds. The latch opening is carried out in a known manner, the latchguard cams 15 and 16 preventing the latches from closing before a needle has picked up the yarn.

As is clearly visible in FIGS. 1*a* and 1*b,* each selecting device is operative on the jacks such as to select each time those needles which are to pick up the yarn delivered by the feed associated with that same selecting device.

The machine illustrated in FIGS. 1*a* and 1*b* lends itself with suitable adaptations, additionally to the three-color Jacquard type of knitting, also to two-color Jacquard knitting, two-color "links-Jacquard", "links-floating" and "derby" knitting. However, for Jacquard knitting, the machine will still require a respective selecting device for each plain stitch yarn feeding station.

Figure 2B:
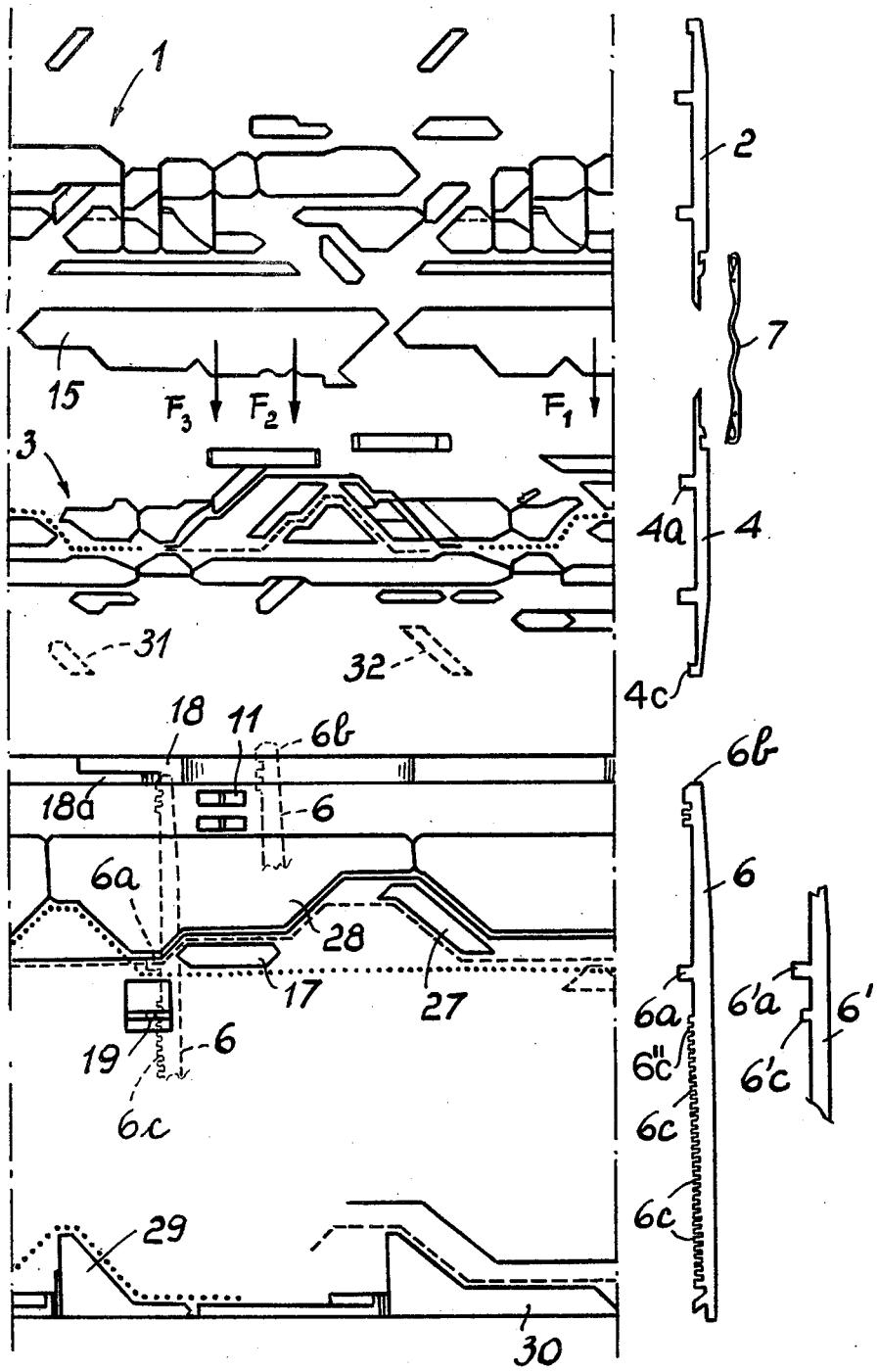
Figure 5:
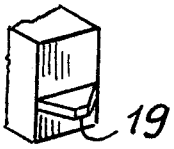
FIGS. 5 and 6 are perspective views, respectively of the resetting cam and auxiliary tilt-out cam of the machine of FIGS. 2*a* and 2*b,* arranged at the selection position without selecting device.
Figure 6:
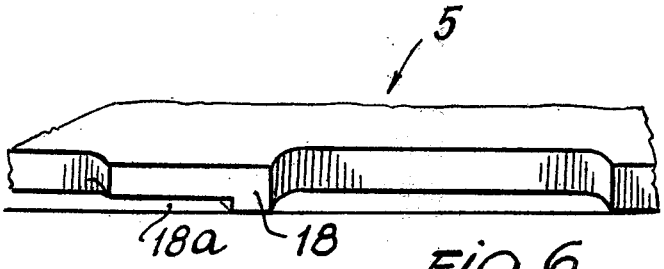

By contrast, and according to this invention, a method and a machine are provided which enable operation in a variety of knitting modes, still with one selecting device less than the number of feeding stations. An exemplary machine according to the invention, having three feeding stations and two selecting devices and suitable for knitting in the three-color rib stitch Jacquard pattern mode, is shown in FIGS. 2*a* and 2*b*. The same numerals and reference symbols have been used in these figures as used with reference to the prior art machine of FIGS. 1*a* and 1*b* to denote corresponding elements and paths.

The machine of FIGS. 2*a* and 2*b* differs from the machine of FIGS. 1*a* and 1*b* substantially for a different form of the cam box 5 for driving the jacks 6. The machine includes only two selecting devices 9 and 10 which are equivalent to the devices 9 and 10 of the machine shown in FIGS. 1*a* and 1*b* and are respectively associated to feeding stations F2 and F3 as are selecting devices 9 and 10 of the machine of FIGS. 1*a* and 1*b*. Selecting device 8 of the machine of FIGS. 1*a* and 1*b* is missing in the machine of FIGS. 2*a* and 2*b*, thus feeding station F1 is a feeding station lacking a selecting device. It also comprises a cam 17 effective to hold the jacks 6 associated with the lower cylinder needles that operate at the feeds F2 and F3 and the jacks corresponding to the needles operating in the upper cylinder at a level of non-interference with the tilt-out cam 11 by causing butts 6*a* to pass above cam 17. Downstream of the cam 17, in the direction of movement of the jacks 6 with respect to the cam box, the inventive machine comprises an auxiliary tilt-out cam 18 operative to bring to a position suitable for raising to work all of the jacks 6 which move at the level defined by the cam 17, as well as an auxiliary resetting cam 19 operative to preclude from raising to work the jacks movable above the cam 17 which are associated with needles that have already formed a stitch at the feeds F2 and F3.

Advantageously, the cam 17 is arranged such as to act on the center butt 6*a* of the jacks 6, whereas the cam 18 is located at a higher level than the cam 11, such as to be active on the heads 6*b* of the jacks 6. The cam 19 is instead located at a level such as to act on the second of the pattern butts 6*c* of the jacks 6, namely the butt indicated at 6″*c* in FIG. 2*b* and hereinafter called "lower reset butt". It should be noted that the neutral jacks 6′ corresponding to the sliders 4 the needles whereof knit in the upper cylinder are not provided with pattern butts 6*c*, but have only the first of such butts 6′*c* hereinafter called "upper reset butt", and the selecting device 10 has an auxiliary upper jack-resetting lever 10*a* which can be withdrawn from the lower cylinder, for reasons that will become apparent hereinafter. The auxiliary tilt-out cam 18 has a recessed portion 18*a* in its lower half to allow the resetting of the jacks 6 by the cam 19, i.e. oscillation of the jacks to a position such that their lower portions are fully within their respective needle tricks in the cylinder.

Machine cams are indicated at 20,21,22,23,24,25,26,27,28,29,30,31, and 32 which are involved in three-colored Jacquard pattern knitting on rib knitting, as will be explained hereinafter. For exemplary purposes, the knitting of a stocking article will be assumed herein. Starting with the beginning of the leg portion (the cuff portion being knitted conventionally), all of the jacks 6 are tilted out by the cam 13, such as to be selected by the selecting device 10. As the upper jack-resetting lever 10*a* resets or cancels all the pattern jacks 6 which are presented with the second pattern butt 6″*c* (or lower reset butt) at the level of the lever 10*a*, as shown in dash lines in FIG. 2*a* where the jack is represented as turned through 90° for clarity, only the neutral jacks 6′ are held tilted out, which are not provided with this second butt and are arranged in the cylinder according to the type of rib stitch knitwork to be produced. In fact, given the type of rib knitwork, all of the jacks associated with the needles which are thereafter to knit in the upper cylinder are raised by the cam 21 and then by the cam 22 brought closer to the cylinder, to transfer the respective needles to rib knit, in a known manner, in the upper cylinder.

After the cylinders have completed one revolution, all the desired needles are transferred to knit in the upper cylinder, then the movable cams 22,23 and 24 are moved away such that the needles transferred to the upper cylinder stay there for the whole duration of the leg portion knitting step.

At this point, the pattern lever 10*a* is withdrawn and the jack selection effected. Those jacks which have been reset or disabled by the selecting device 10 stay low, whereas the others, which stay tilted out, engage with the cam 21 carrying them, together with the neutral jacks 6′ which are not reset by any lever of the selecting device 10, in the path defined by the cams 25 and 26. In following this path, the selected jacks reach the cam 27, thereby the respective sliders are raised and the corresponding needles brought to pick up the yarn from the feed F3, while the sliders of the neutral jacks (that is the sliders corresponding to needles knitting in the upper needle cylinder) advantageously open the overlying latches of the needles to allow these needles to knit in the upper cylinder at feed F3.

Then such jacks are all lowered onto the cam 28, to reach, owing to the presence of the cam 17, an inoperative position in which they do not interfere with the tilt-out cam 11 associated with the feeding station F1 as shown in dash lines in FIG. 2*b*, thereafter those same jacks are all tilted out by the cam 18, i.e. are brought to a position such that they can be raised by the cam 29. At this point, however, the jacks associated with the needles that have been knitting at the feed F3 are all reset or disabled by the cam 19 interfering with the lower reset butt 6″*c* (the same one that has been reset by the lever 10*a* during the previous revolution), as shown in dash lines in FIG. 2*b*, whereas the jacks associated with the sliders the needles whereof are knitting in the upper cylinder are not reset, these being without a corresponding lower reset butt 6″*c* as stated above and they are the only ones that are raised by the cam 29 to bring the respective sliders into the path that will subsequently direct them to open the latches of the overlying needles at the latchguard cam 16. The resetting of the pattern jacks 6 by the auxiliary cam 19 is permitted by the recess 18*a* in the cam 18. The reset jacks further continue at mid-height leaving their respective sliders in the "floating" path, and will be again selectable for the subsequent course. Cam 19 therefore provides a selection between the jacks associated with the needles which knit at feeds F2, F3 and the jacks corresponding to the needles knitting in the upper needles cylinder. Cam 19, however, is not a selection device proper like devices 9 and 10, because it does not produce a pattern selection.

By contrast, the jacks 6 which have been reset by the selecting device 10 arrive low at the selecting device 9, whereto they are all presented tilted out by virtue of the tilt-out cam 12. The selection of such jacks is here carried out according to the pattern, such that some of them are reset and advance low, while others are held tilted out and are raised by the cam 30, thereby the respective sliders are also raised and the corresponding needles brought to pick up the yarn at the feed F2. Those jacks which have engaged the cam 30 join then the jacks the needles whereof have been knitting at the feed F3 as well as the neutral jacks 6', they being also influenced by the cams 17,18 and 19 in the manner described hereinabove. Thus, the jacks associated with the needles that have been knitting at the feed F2 are also no longer involved, during that same knitting course, by the raising cam 29.

The jacks which have been reset by the selecting device 9 move instead low, and reach the cam 29 in the tilted out condition (because their heads **6*b* interfere with the tilt-out cam 11), thereby they are all raised by the cam 29; the corresponding sliders are also raised and the respective needles brought to pick up the yarn from the feed F1. It will be noted that no selecting device is required any more for these remaining jacks since all of the jacks the needles whereof have already been knitting have been brought to a position such that they are not tilted out to raise on cam 29 for knitting in the same knitting course, thereby there remain but these jacks to be raised in order to bring the corresponding needles to knit at the feed yet left inactive for the same course. In other words, knitting initiated at feeds F2, F3 is terminated at feed F1 for each given course of knitting, because the needles which knit at feed F1 are those which remain after pattern selection by means of selecting devices 9 and 10** has been carried out.

Thus, it has been shown how on completion of one revolution by the needle cylinders, i.e. of one knitting course, all of the needles have been able to knit or form a stitch selectively, in conformity with the pattern preset on a number of selecting devices (drums) by one unit lower than the number of the feeding stations. At this stage, a fresh knitting course is initiated, with another selection being carried out in the manner described hereinabove.

The machine described above may be advantageously adapted for either "links" or "links-floating" knitting, thanks to the fact that the selecting device 9 can be precluded and the cams 22,23 and 24 moved closer to the cylinders. In such a case, the selecting device 10 would carry out a "links" selection and the feed F2 precluded, such as to have here too a number of selecting devices that is by one less than the feeding stations.

Figure 3:
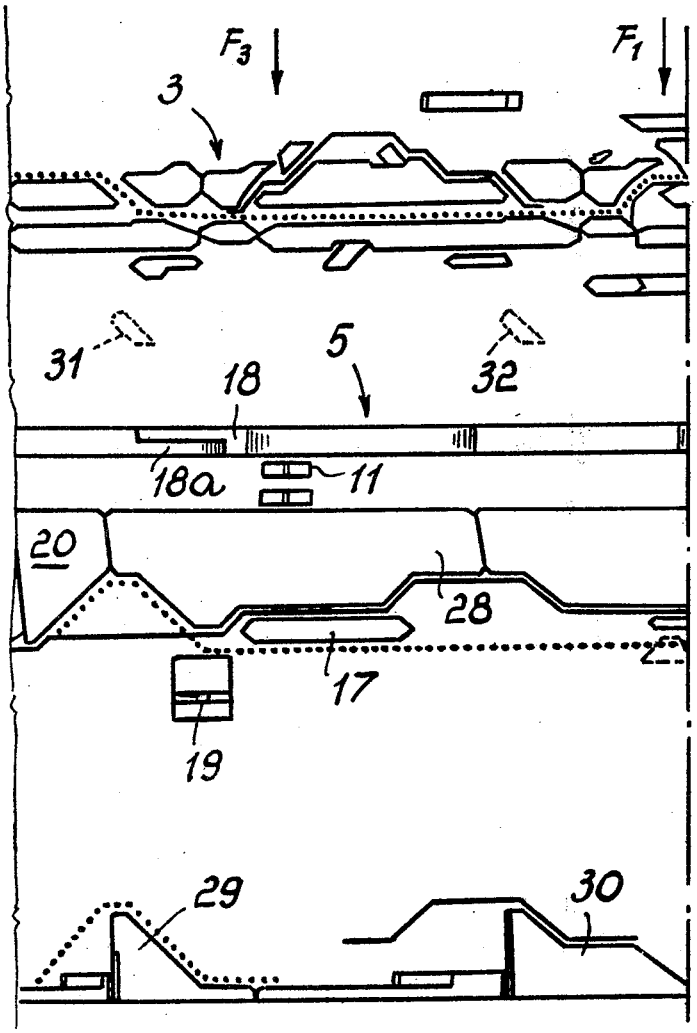
FIGS. 3 and 4 are partial views of the cams, respectively of a machine according to the invention and equipped with but two feeding stations, and of a machine according to the invention and suitable for the two-color "links-Jacquard" type of knitting.

Futhermore, the inventive machine may also be adapted for two-color Jacquard rib knitting by utilizing one selecting device. In fact, by precluding the selecting device 9 and removing the feed F2, a knitting mode is afforded with only two colors, which correspond to the ones described above with reference to the feeds F1 and F3 and to the jacks and sliders that move along the paths shown in dotted and dash lines. Also in this case the opening of the latches of the purl stitching needles would be ensured, since the movement of the neutral sliders 6' is not influenced by the selecting device 9 which is missing. Thus the machine may be simplified in this instance, as illustrated in FIG. 3 showing the simplicity but that portion of the cam assembly which carries the modified cams with respect to the machine of FIGS. **2*a* and 2*b*. It will be noted that the cams at the feed F3** are of more economical configuration both for the sliders and for the jacks. This machine may also be adapted for "links" operation.

Figure 4:
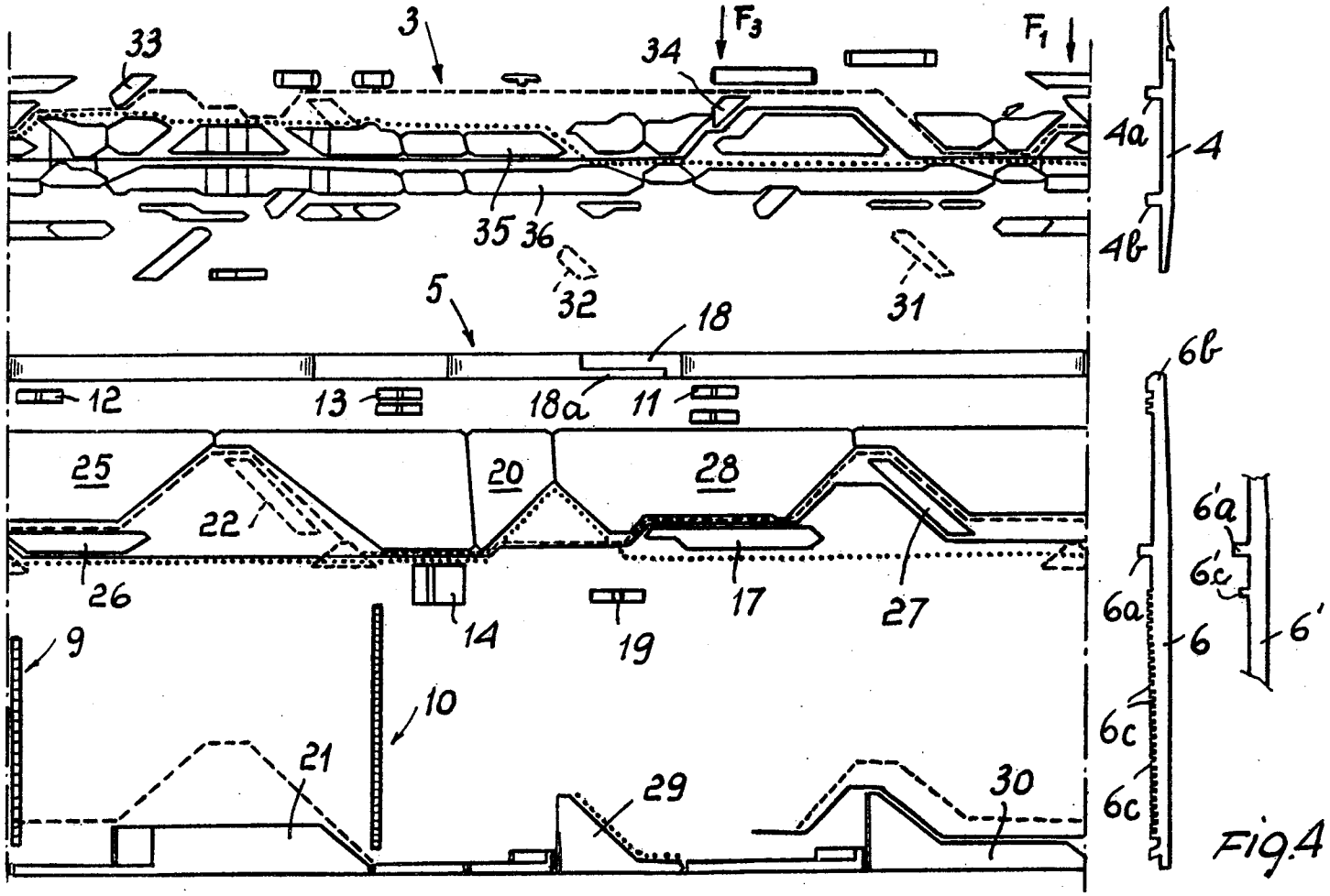

FIG. 4 shows the cam assembly for a two-color "links-Jacquard" machine. The machine differs from that of FIGS. **2*a* and 2*b* in the shape of the cams in the cam box 3 and in the cam 27 which is higher. In this machine, the selecting device 10 is utilized for "links" selection, i.e. for selecting the needles that are to knit in the upper cylinder, the selecting device 9 being used for the Jacquard selection. As shown on one side of FIG. 4, this machine is equipped with sliders which do not have a lower tilt-out butt (like tilt-out butt 4*c* of FIG. 2*b*) projecting from the needle cylinder; these sliders are therefore enabled to move past the cams 31 and 32**, while actuated, without undergoing any damage.

In knitting a stocking article, at the start or beginning of the leg portion, the selecting device 10 effects the selection of the needles which are to be transferred to purl knitting. In a known manner, the jacks of the needles selected for such a transfer are raised by the cams 21 and 22, thus raising the respective slider and corresponding needle for the hooking up and transferment to purl stitching. The paths of the corresponding jacks and of the sliders are shown in dash lines. (The raising of the sliders is also carried out by the cams that act on the butt **4*b* thereof, the path thereof being not shown.) The sliders are then lowered by the cam 33, and the jacks 6 are lowered by the cam 25 into the storage path above the cam 26. In followng this path, those same jacks are again raised by the cam 27 to bring the respective sliders back to crossing the overlying purl stitching needles, by opening their latches. Next, the jacks are lowered onto the cam 28 and are reset or disabled by the cam 19, and then move towards the selecting device 10 for re-selection. The corresponding, raised, sliders are advanced standing on the cam 34 of the feed F3, whereon a passage is provided, contrary to the machines of FIGS. 2*b* and 3. The sliders, while further advancing in their high position, are again enabled to cross the needles coming from the purl stitching mode and bring them to plain stitching, in a known manner, for fresh selection by the selecting device 10**.

For the "links-Jacquard" cycle, the cams 31 and 32 are withdrawn from the lower needle cylinder. The selection for color is effected, as mentioned previously, through the selecting device 9, whereat all of the jacks are tilted out by interaction with the cam 12. The jacks selected to bring to work the corresponding needles climb the cam 30, thereby the respective sliders bring the needles to pick up the yarn from the feed F3. Therefore, the jacks intermingle with those selected by the selecting device 10 and are reset by the cam 19, thereby the corresponding sliders stay in the "floating" path defined between the cams 35 and 36, and the respective needles leave out the feed F1.

Those jacks which have not been selected for operation by the selecting device 9 remain low and reach the raising cam 29 all tilted out (their butts **6*c* are, in fact, at a lower level than the cam 19), which cam raises the jacks and corresponding sliders, thereby the associated needles are routed to the path which, as shown, brings them to pick up the yarn from the feed F1**. The jacks are then lowered again and join the rest, and all of the jacks are thus ready for fresh selection for the following course. Also in this case, use is made of a number of selecting devices lower by one than the number of feeding stations.

It will be noted, therefore, that a machine according to this invention lends itself to a plurality of different knitting modes, with but a few modifications to the cam shapes, to allow in any circumstances the elimination of one selecting device and, accordingly, afford considerable advantages of an economical nature.

Obviously the invention allows for many modifications and variations in addition to the exemplary embodiments illustrated in the drawings.

I claim:

1. A method for manufacturing patterned knitted fabrics, in particular stocking articles, on a double cylinder circular knitting machine having upper and lower needle cylinders, needles and corresponding sliders slidable therein, jacks associated with the sliders slidable in said lower needle cylinder, jacks corresponding to needles knitting in said upper needle cylinder, a number of yarn feeding stations, jack tilt-out cams associated with said feeding stations, and jack selecting devices, wherein the jacks corresponding to the needles in said lower needle cylinder selected to pick up yarn at said feeding stations but one of said feeding stations and the jacks corresponding to the needles in said upper needle cylinder are brought, after said selected needles have each formed a stitch, to an inoperative position in which they do not interfere with that of said tilt-out cams which is associated with said one of said feeding stations, said jacks brought to said inoperative position being subsequently brought all to a position such that they can be raised to bring corresponding needles to pick up yarn at said but one of said feeding station, and wherein those of said jacks are precluded from being raised, which are associated with said selected needles knitting in said lower needle cylinder and each having already formed a stitch a same knitting course.

2. A double cylinder circular knitting machine for manufacturing patterned knitted fabrics, in particular stockings, comprising upper and lower needle cylinders, needles and corresponding sliders slidable therein, jacks in said lower needle cylinder comprising jacks associated with sliders and needles slidable in said lower needle cylinder and jacks corresponding to needles knitting in said upper needle cylinder, a number of yarn feeding stations, selecting devices for said jacks in said lower needle cylinder, tilt-out cams each associated to a corresponding one of said feeding stations and provided for disposing said jacks in said lower needle cylinder in a position suitable for selection by said selecting devices, and jack-raising cams each associated to a corresponding one of said yarn feeding stations, wherein the machine has a number of said selecting devices by one unit smaller than the number of said yarn feeding stations thus having a yarn feeding station lacking a corresponding one of said selecting devices, and further comprises cams associated with said yarn feeding station lacking a selecting device, said cams including a cam for holding those of said jacks associated with needles slidable in said lower needle cylinder which are associated with needles picking up yarn at a yarn feeding station other than said feeding station lacking a selecting device during a given knitting course and said jacks corresponding to needles knitting in said upper needle cylinder at a level at which the held jacks do not interfere with that of said tilt-out cams which is associated with said yarn feeding station lacking a selecting device, an auxiliary tilt-out cam for bringing all of the jacks movable at said level to a position suitable for being raised by that of said jack-raising cams that is associated to said yarn feeding station lacking a selecting device, and a resetting cam for precluding from raising those of said jacks movable at said level which are associated with needles slidable in said lower needle cylinder and each having already formed a stitch in said given knitting course.

3. A machine according to claim 2, wherein said jacks in said lower needle cylinder each has a head and said auxiliary tilt-out cam is located at a higher level than said tilt-out cam associated with said feeding station lacking a selecting device, said auxiliary tilt-out cam interfering with said heads of said jacks movable at said level.

4. A machine according to claim 2, wherein said jacks in said lower needle cylinder each has a head and said auxiliary tilt-out cam has a recessed portion to allow said heads of said jacks interfering with said resetting cam to be tilted out.

5. A machine according to claim 2, wherein said jacks corresponding to needles knitting in said upper needle cylinder each has an upper reset butt and said jacks associated with needles slidable in said lower needle cylinder each has a lower reset butt, said resetting cam being located at a level such as to be active on said lower reset butt of said jacks movable at said level.

6. A machine according to claim 2, wherein said jacks corresponding to needles knitting in said upper needle cylinder each has an upper reset butt and said jacks associated with needles slidable in said lower needle cylinder each has a lower reset butt, one of said selecting devices having an upper jack-resetting lever adapted to act on said lower reset butt.

7. A machine according to claim 2, wherein said sliders slidable in said lower needle cylinder comprise sliders having a lower tilt-out butt and sliders lacking said lower tilt-out butt.

* * * * *